US011944183B1

(12) United States Patent
Steinbock et al.

(10) Patent No.: US 11,944,183 B1
(45) Date of Patent: Apr. 2, 2024

(54) WATERPROOF PACK

(71) Applicant: Matbock, LLC, Virginia Beach, VA (US)

(72) Inventors: Zachary L. Steinbock, Virginia Beach, VA (US); Sean M. Matson, Virginia Beach, VA (US)

(73) Assignee: Matbock, LLC, Virginia Beach, VA (US)

( * ) Notice: Subject to any disclaimer, the term of this patent is extended or adjusted under 35 U.S.C. 154(b) by 0 days.

(21) Appl. No.: 15/202,181

(22) Filed: Jul. 5, 2016

Related U.S. Application Data

(60) Provisional application No. 62/188,234, filed on Jul. 2, 2015.

(51) Int. Cl.
*A45F 3/04* (2006.01)
*A45F 3/10* (2006.01)

(52) U.S. Cl.
CPC . *A45F 3/04* (2013.01); *A45F 3/10* (2013.01)

(58) Field of Classification Search
CPC ..... A45F 3/04; A45F 3/10
USPC ..... 224/583
See application file for complete search history.

(56) References Cited

U.S. PATENT DOCUMENTS 4,563,777 A * 1/1986 Park ..... A41D 15/04 2/108
4,648,121 A * 3/1987 Lowe ..... A45F 3/04 224/259
5,012,964 A * 5/1991 Falletta ..... A45F 3/04 224/153
5,154,332 A * 10/1992 Williams ..... A45F 3/04 190/26
5,628,443 A * 5/1997 Deutsch ..... A45C 7/0086 150/113
6,464,098 B1 * 10/2002 Henson ..... A47B 43/00 220/475
8,152,374 B2 * 4/2012 Shaul ..... A45C 13/002 150/105
8,870,045 B1 * 10/2014 Aguirre ..... A45F 3/04 224/581
8,919,628 B2 * 12/2014 Jamlang ..... A45F 3/10 224/153
2004/0089683 A1 * 5/2004 Theodore ..... A45C 13/02 224/153
2005/0061844 A1 * 3/2005 Haro ..... A45C 13/04 224/639
2007/0272719 A1 * 11/2007 Laughton ..... A45C 11/38 224/629
2010/0147918 A1 * 6/2010 Hensley ..... B62J 9/001 224/600
2011/0186611 A1 * 8/2011 Eberle ..... A45F 3/04 224/583
2012/0031943 A1 * 2/2012 Koutouras ..... A45C 13/02 224/653
2013/0264161 A1 * 10/2013 Thompson ..... A45C 7/0022 190/103

* cited by examiner

*Primary Examiner* — Derek J Battisti
(74) *Attorney, Agent, or Firm* — Dinsmore & Shohl LLP

(57) ABSTRACT

The invention is waterproof pack for carrying articles that includes a frame and a pair of shoulder straps secured thereto. The invention further includes a waterproof membrane having a body secured to the rear side of the frame and a flap closure secured to the body by a waterproof zipper, wherein the body and the flap closure form a waterproof bag when the waterproof zipper is closed.

6 Claims, 14 Drawing Sheets

WATERPROOF PACK

FIELD OF THE INVENTION

The present invention relates generally to a pack for carrying articles and more specifically to a waterproof combat pack that may be converted to be used in multiple configurations in the field.

DETAILED DESCRIPTION OF THE PREFERRED EMBODIMENT(S)

Figure 1:
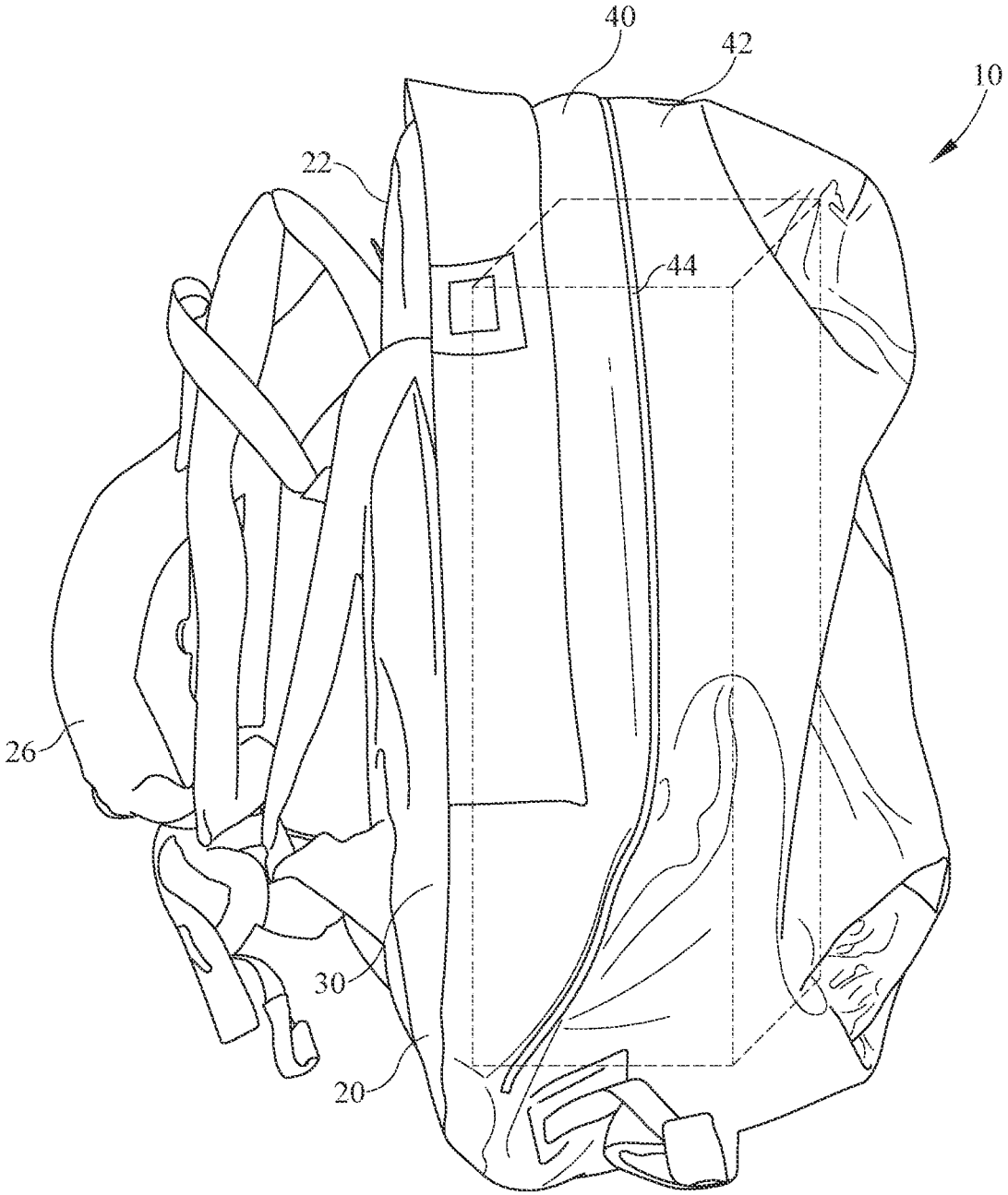
FIG. 1 is a side view of a waterproof pack in accordance with one embodiment of the present invention.
Figure 2:
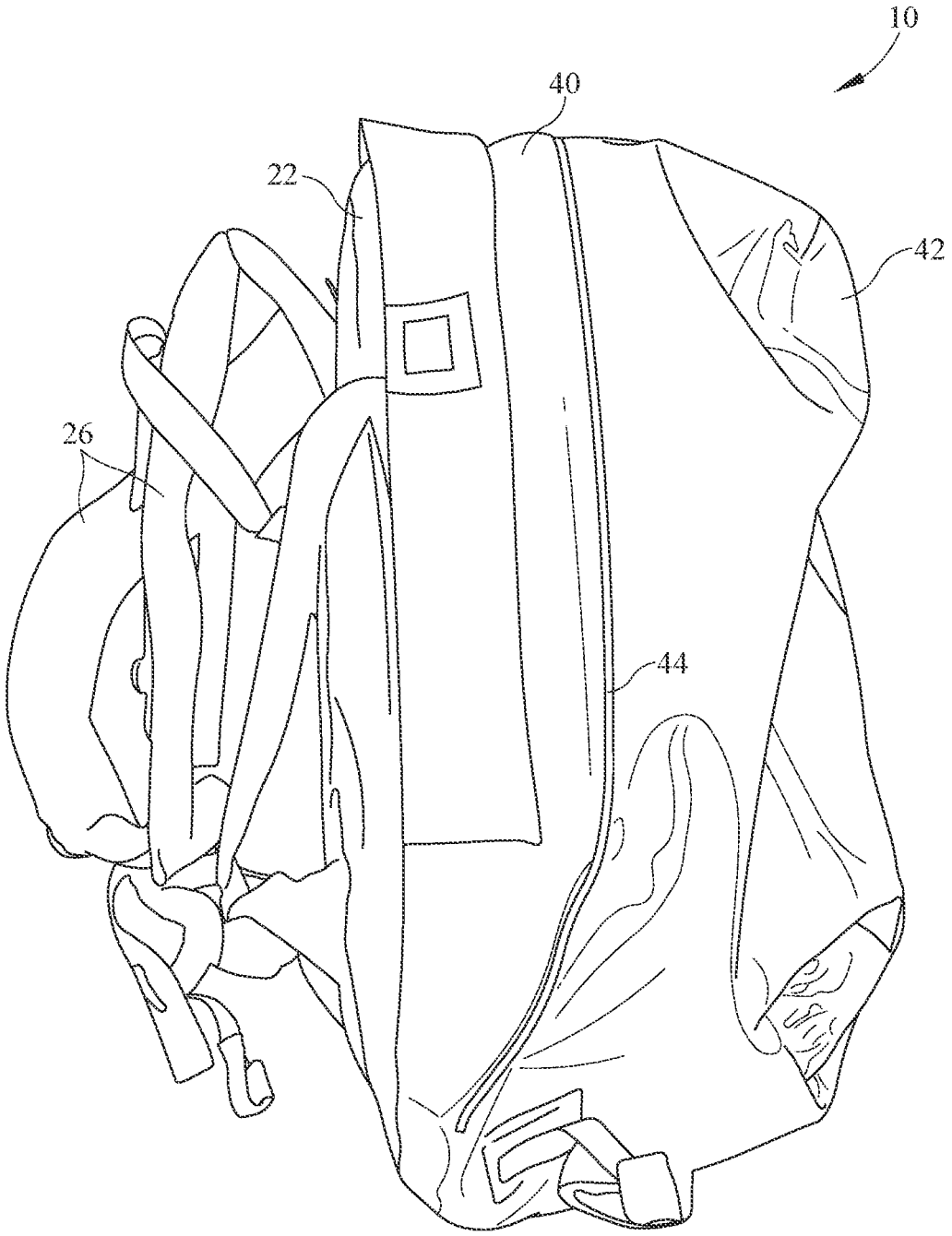
FIG. 2 is a side view of a waterproof pack in accordance with one embodiment of the present invention.
Figure 3:
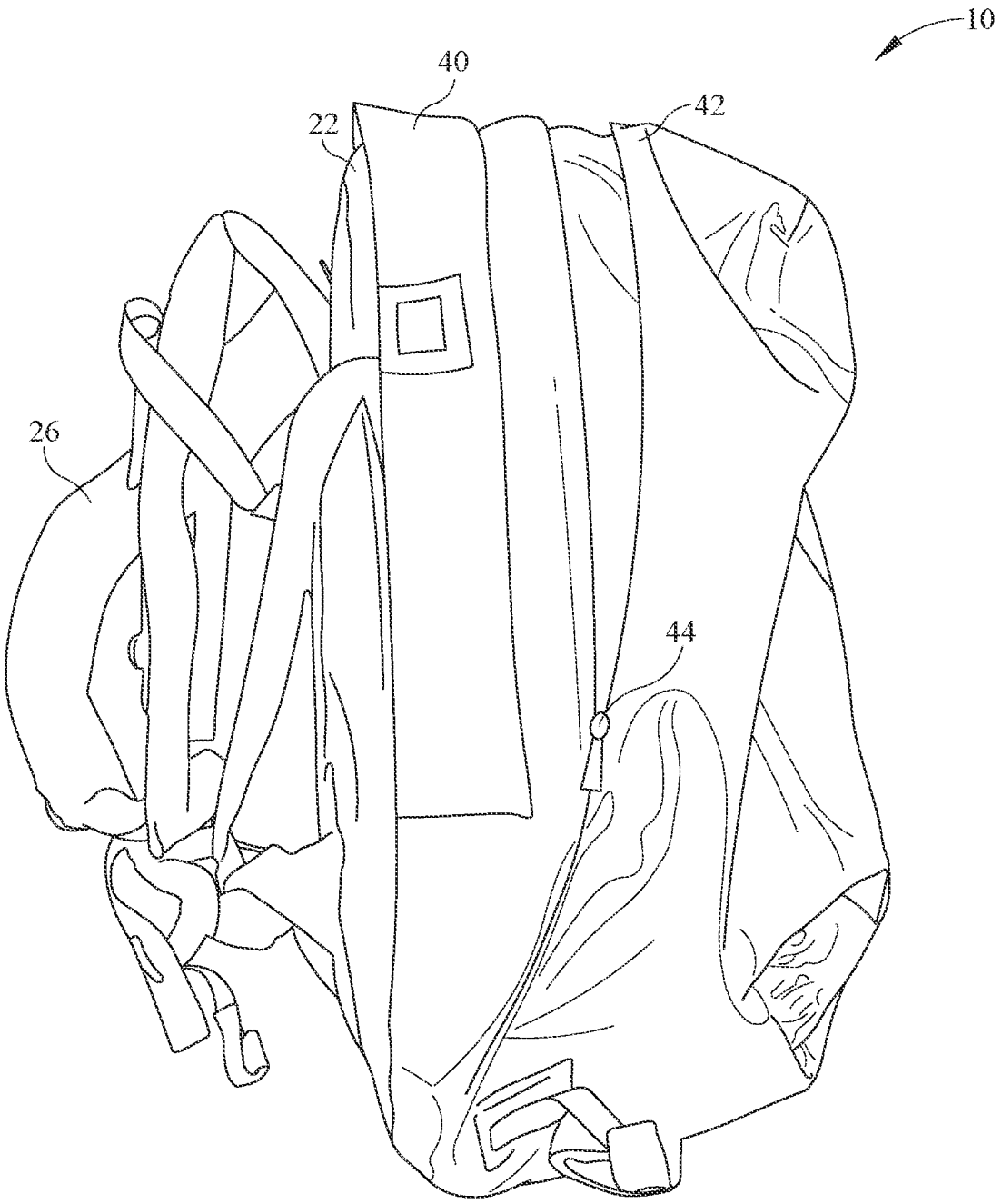
FIG. 3 is a side view of a waterproof pack in accordance with one embodiment of the present invention.
Figure 4:
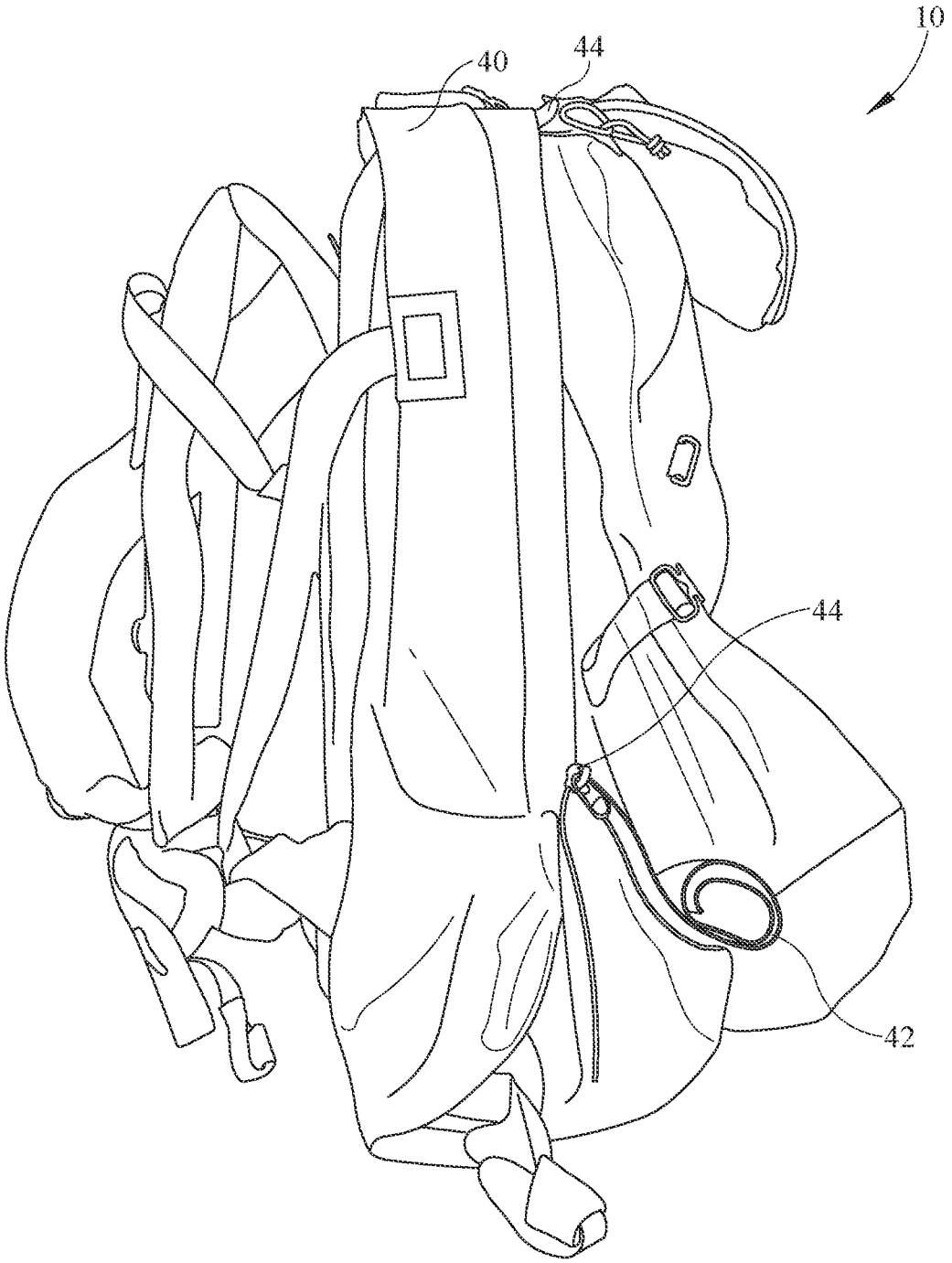
FIG. 4 is a side view of a waterproof pack with the outer membrane partially unizipped in accordance with one embodiment of the present invention.
Figure 5:
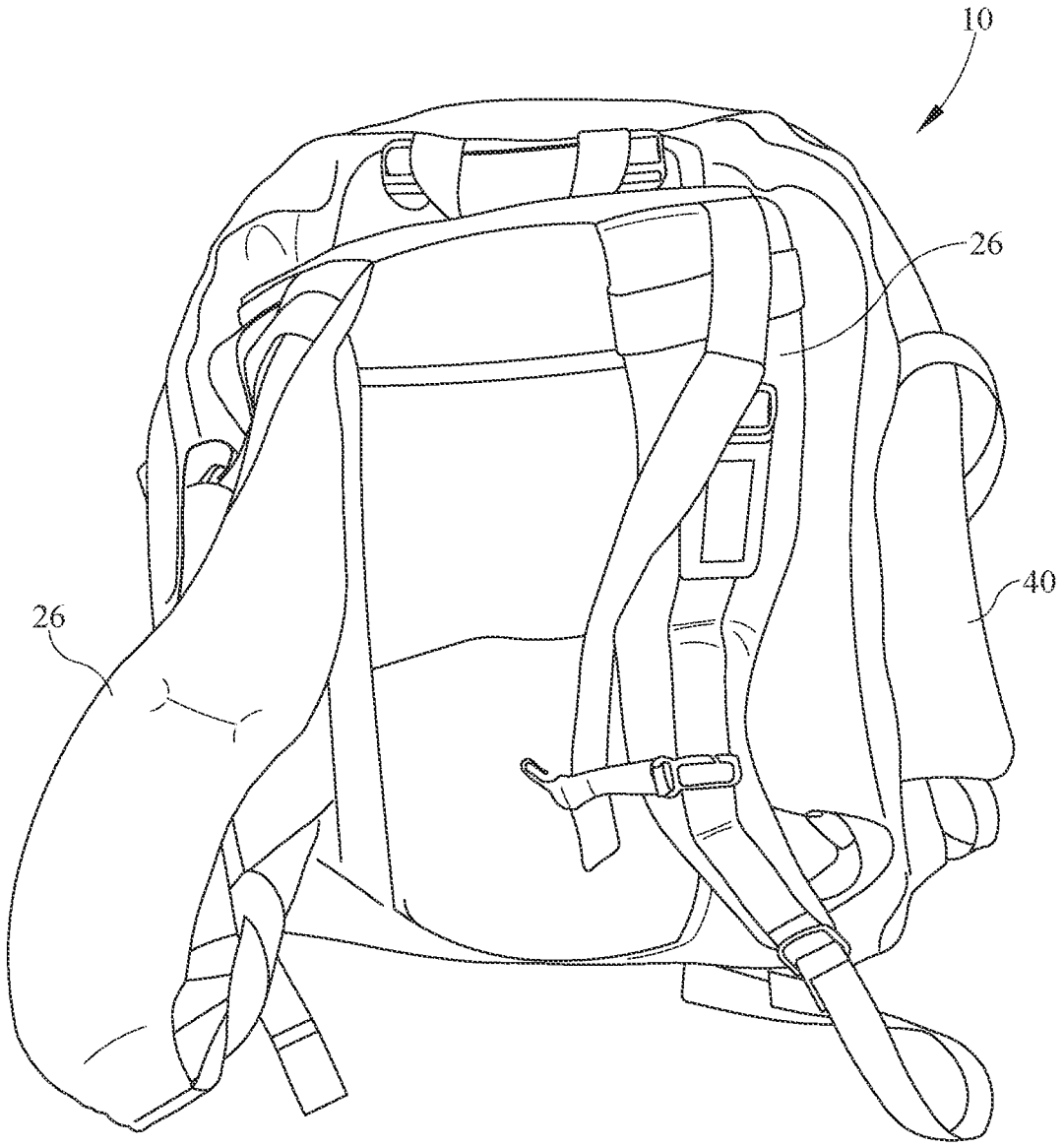
FIG. 5 is a front view of a waterproof pack in accordance with one embodiment of the present invention.
Figure 6:
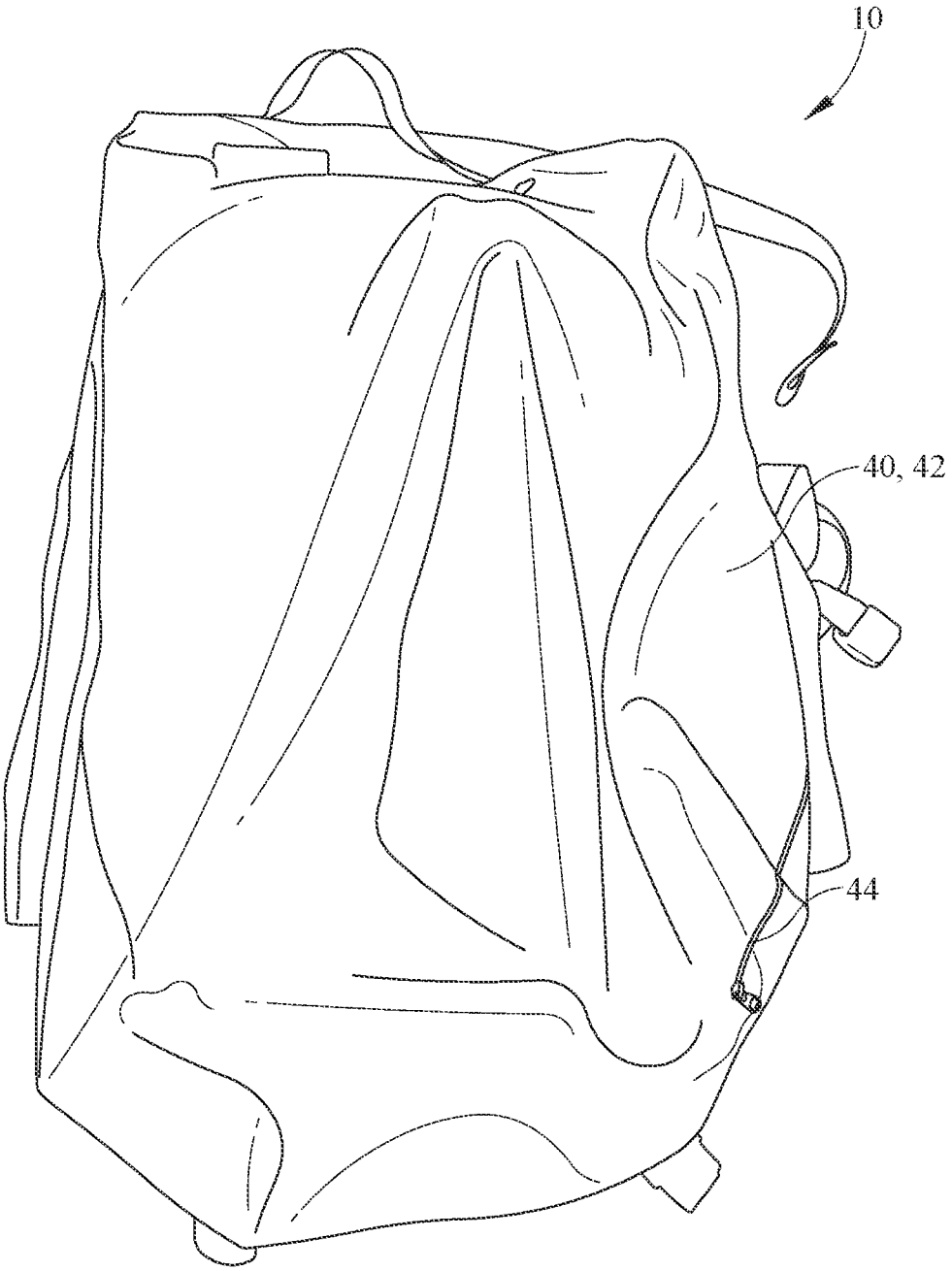
FIG. 6 is a rear view of a waterproof pack in accordance with one embodiment of the present invention.

Referring now to the drawing Figures, and in particular FIGS. 1-5, and in accordance with a constructed embodiment of the present invention a waterproof and convertible pack 10 for carrying articles is provided having a frame 20 with front 22 and rear 24 sides, the frame 20 front side 22 having a pair of shoulder straps 26 secured thereto. In one non-limiting and exemplary embodiment of the invention frame 20 may comprise internally disposed or positioned rigid or semi-rigid frame members 30, also formed of waterproof material, that provide pack 10 with a measure of rigidity and also provide comfort for a user. Frame members 30 may comprise plastic or fiberglass material, or even metal or metal alloys without departing from the scope of the invention.

In a yet further embodiment of the invention shoulder straps 26 and frame members 30 may be detachably secured to frame 20 so that they can be removed for future use, as described below. Furthermore, shoulder straps 26 may be constructed of quick-drying material so that once removed from a wet environment, straps 26 dry out and do not rub or chafe a user as badly as conventional shoulder straps 26.

Pack 10 further comprises a waterproof membrane 40 secured to rear side 24 of frame 20 at a plurality of points. Membrane 40 includes a waterproof flap closure 42 that is secured to membrane 40 via a waterproof zipper 44. Waterproof membrane 40 may comprise one of a variety of waterproof materials, such as neoprene, heavy-duty plastics, nylon fabrics, rubber, coated nylon fabrics and the like. Waterproof zipper 44 may extend substantially down both sides of pack 10, and across the top thereof, such that flap closure 42 and membrane 40 share a common material portion at only a small bottom section of pack 10. As best seen in FIGS. 1-4, 8 and 13 this feature of the invention 10 provides the ability for a user to unzip flap closure 42 thereby exposing the interior contents of pack 10, and roll flap 42 up or stow it during use, as will be discussed below.

Figure 7:
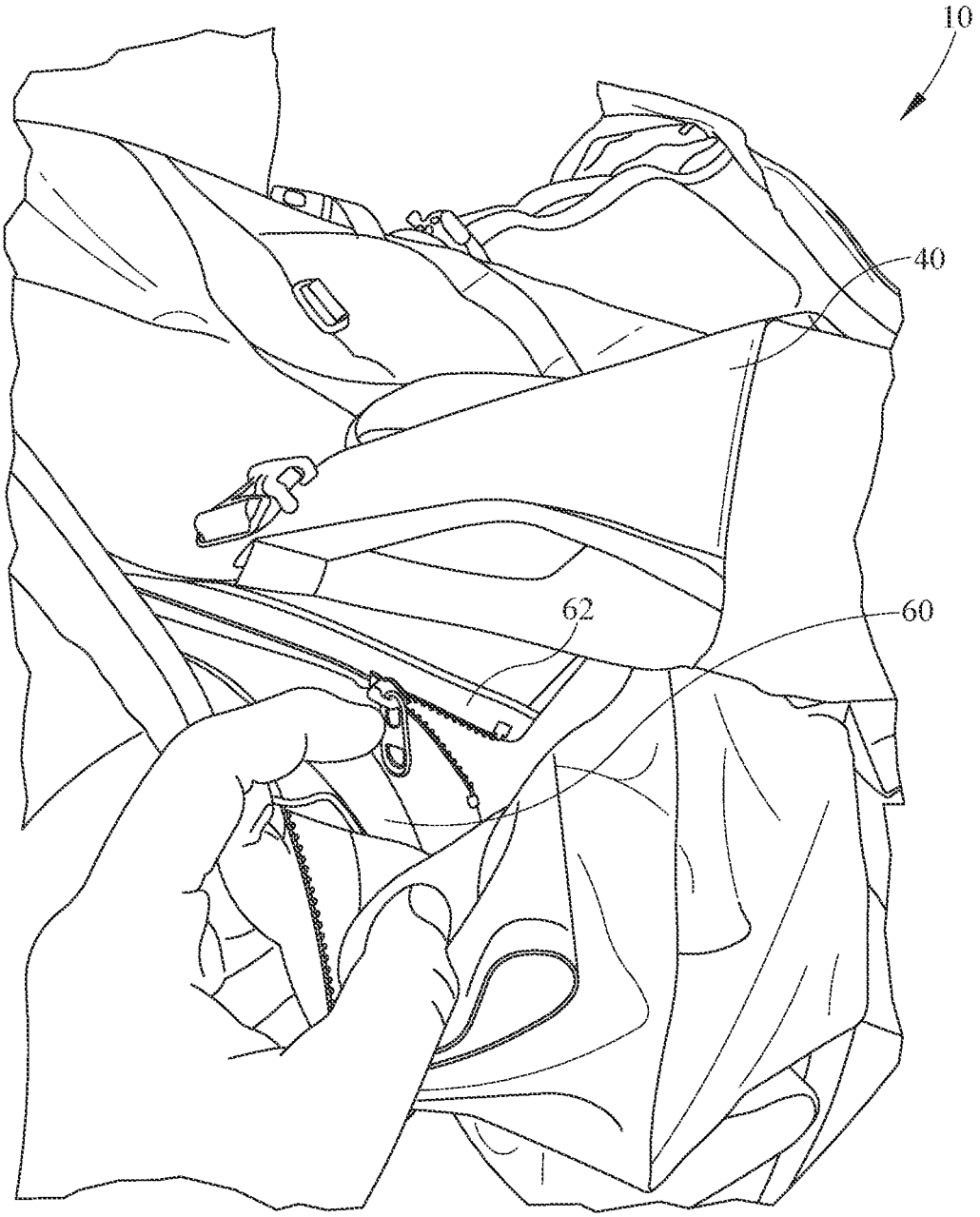
FIG. 7 is a perspective view of the attachment of an interior pack with the exterior membrane in accordance with one embodiment of the present invention.
Figure 8:
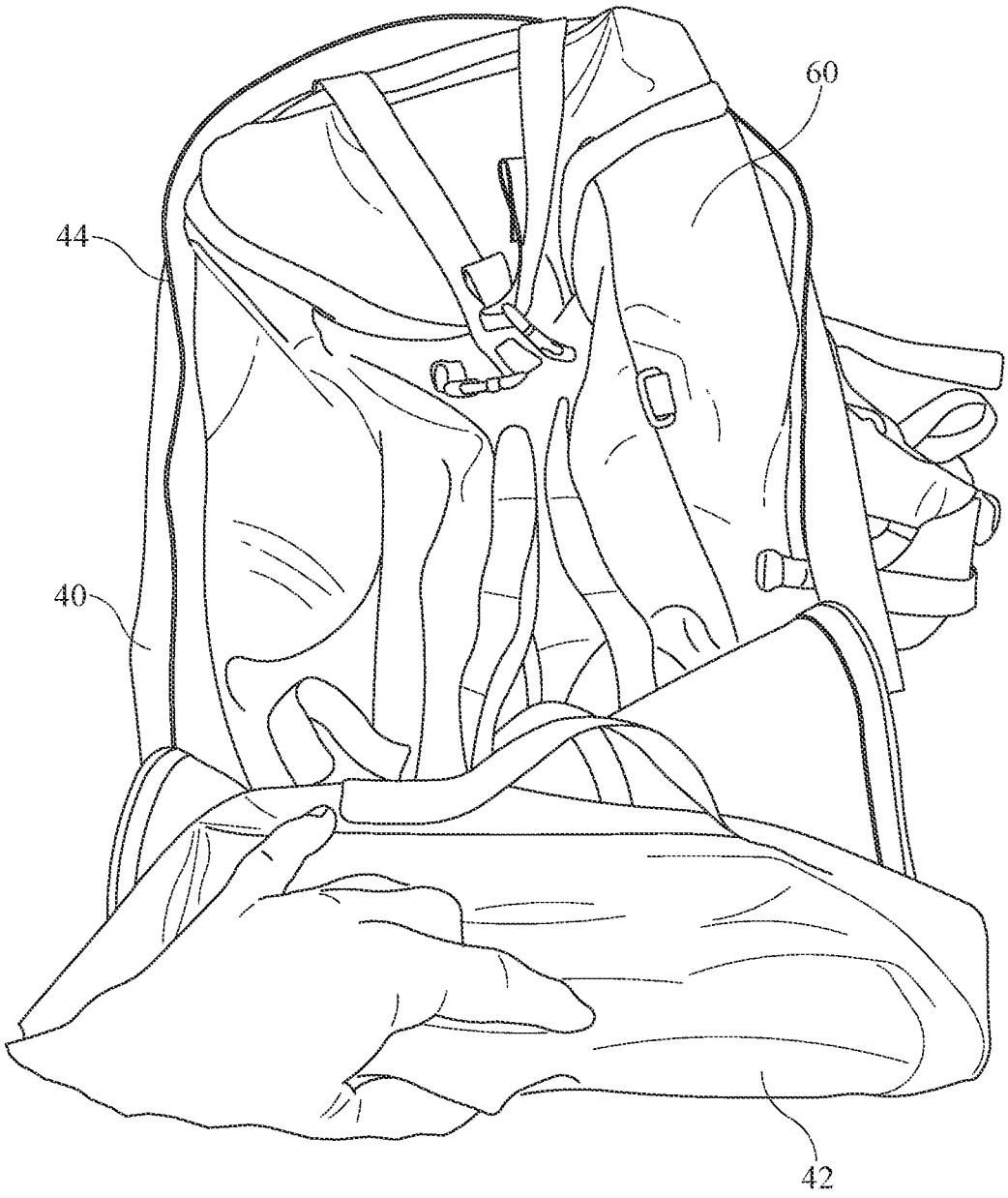
FIG. 8 is a perspective view of a flap closure being folded down in accordance with one embodiment of the present invention.
Figure 9:
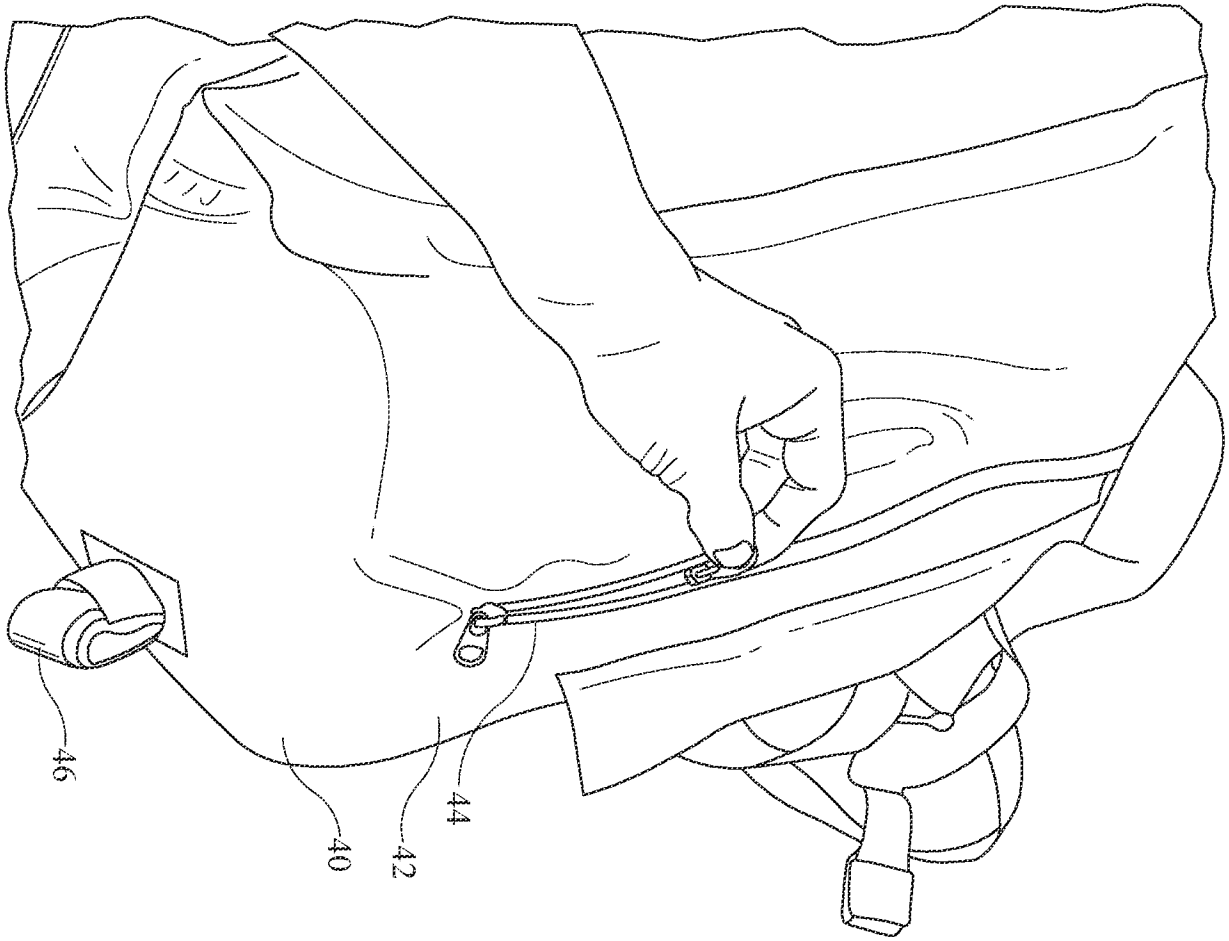
FIG. 9 is a perspective view of a flap closure being zipped in accordance with one embodiment of the present invention.
Figure 10:
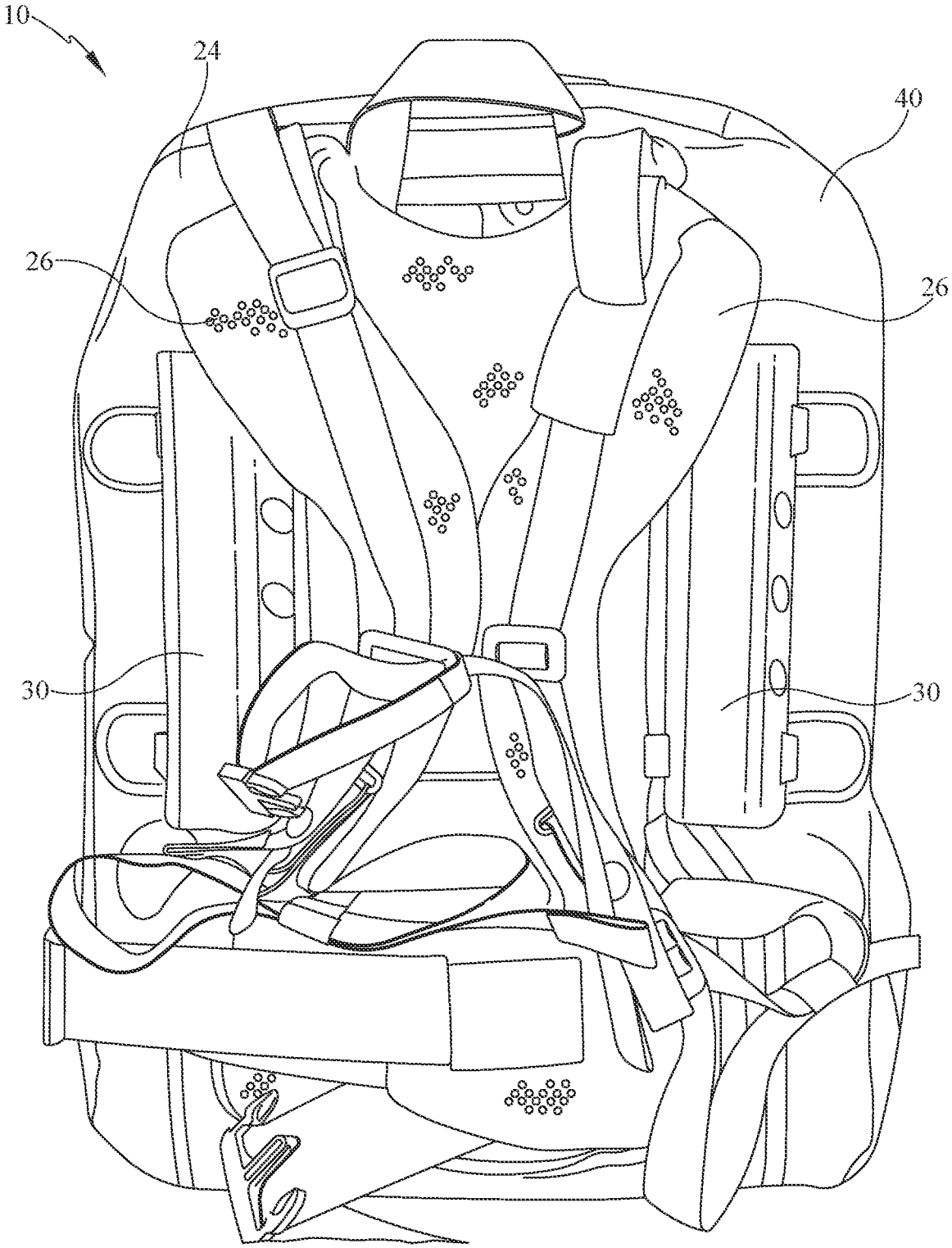
FIG. 10 is a front view of a waterproof pack in accordance with one embodiment of the present invention.
Figure 11:
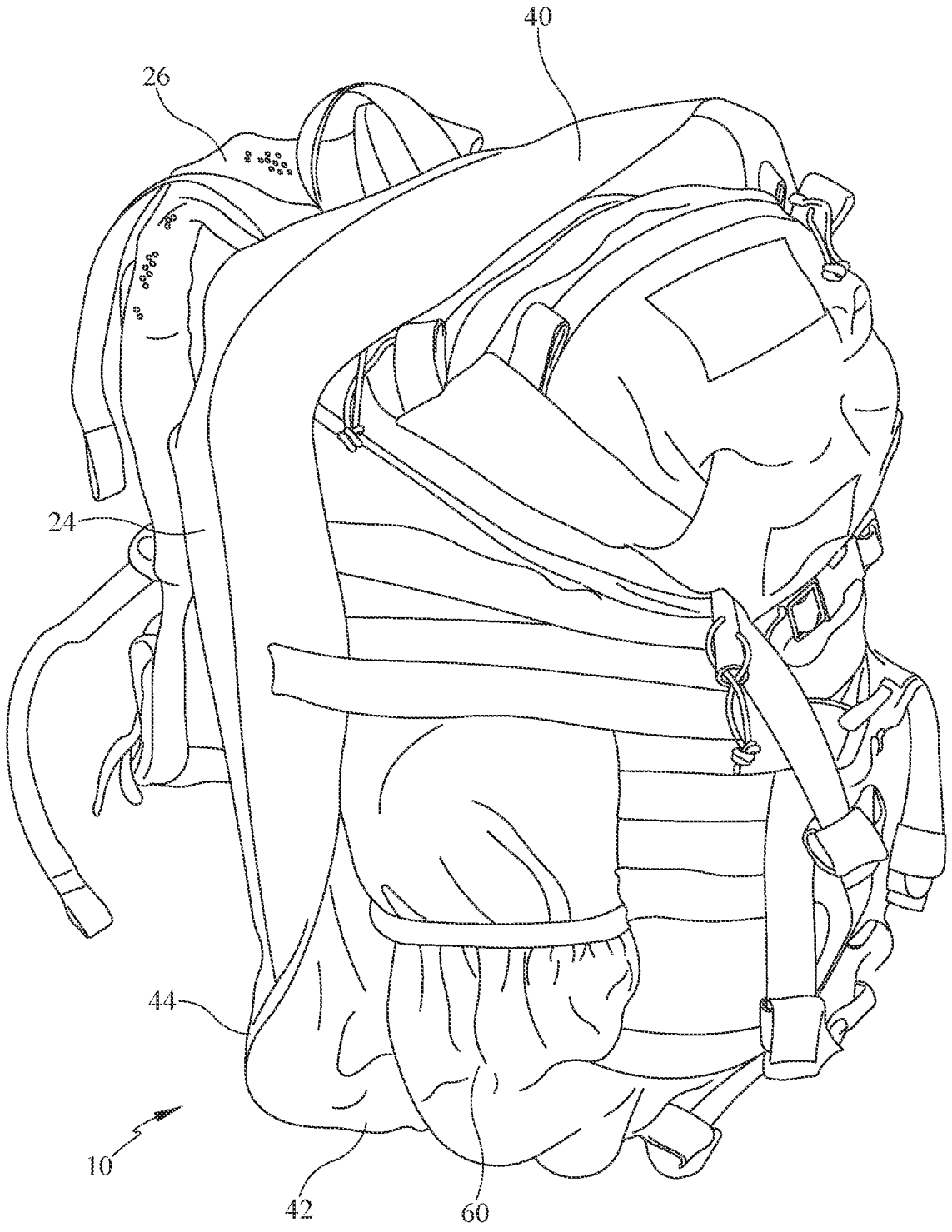
FIG. 11 is a perspective view of a waterproof pack in accordance with one embodiment of the present invention.
Figure 12:
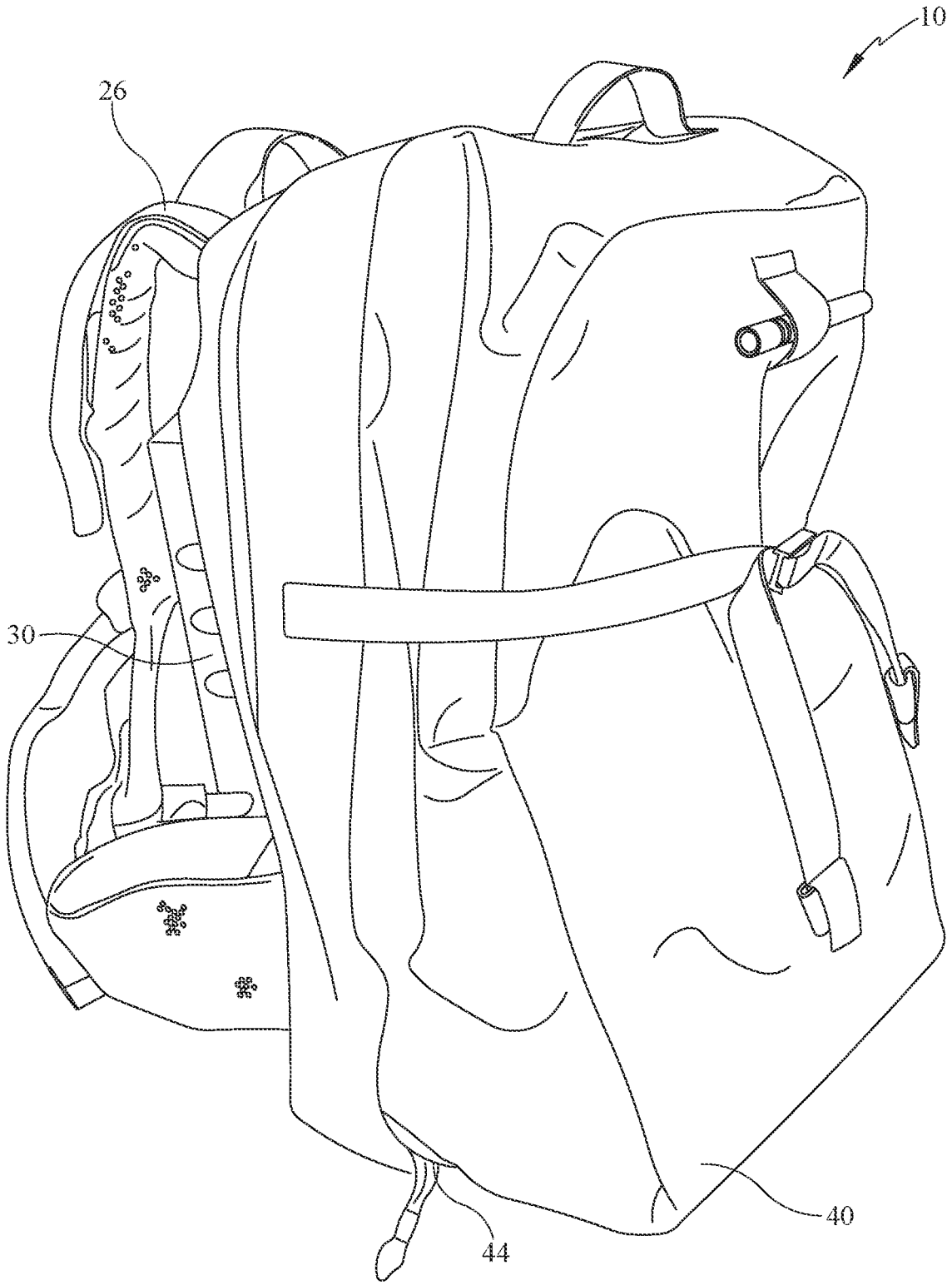
FIG. 12 is a perspective view of a waterproof pack in accordance with one embodiment of the present invention.
Figure 13:
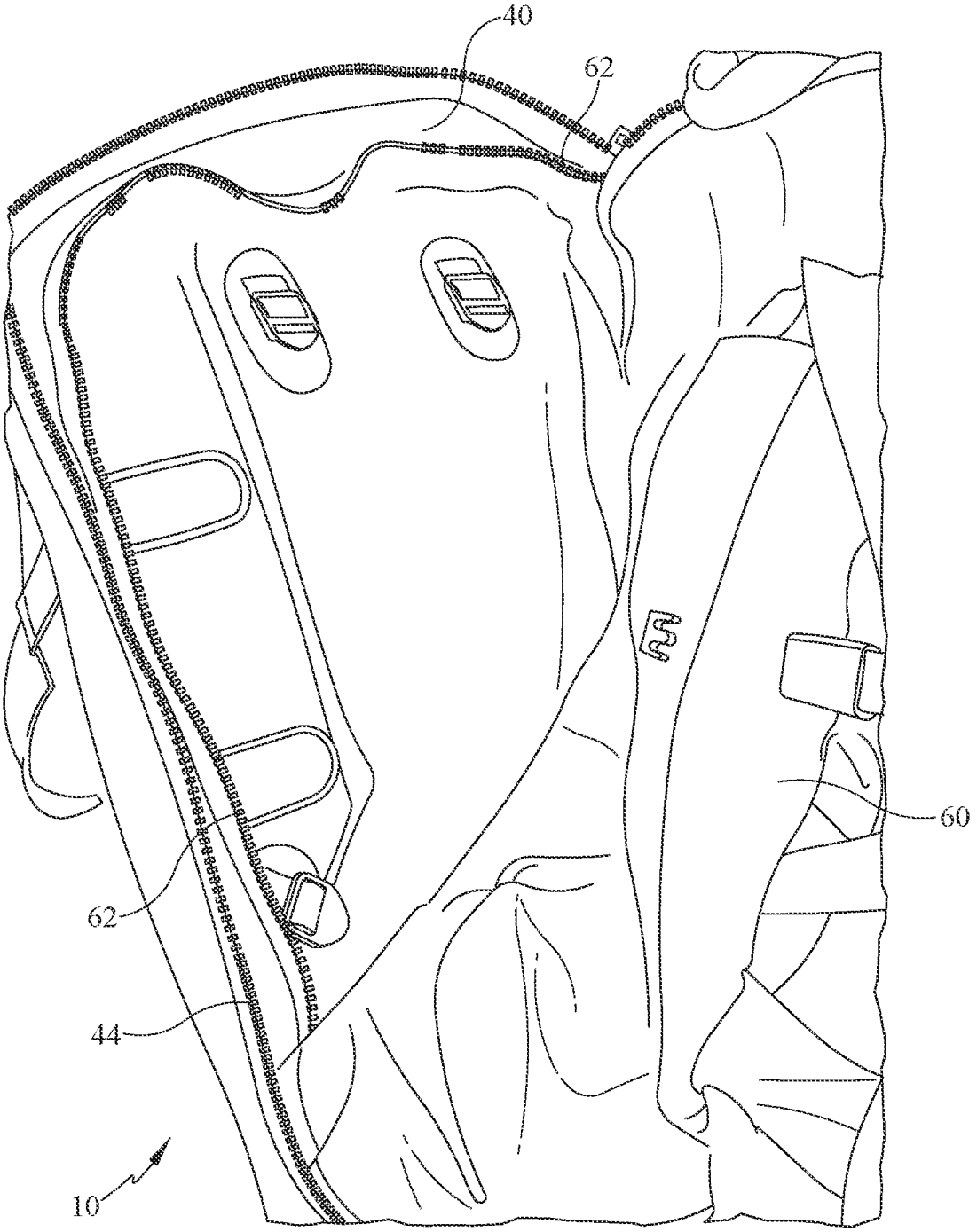
FIG. 13 is a perspective view of a waterproof pack in accordance with one embodiment of the present invention.

Pack 10 further comprises an interior pack or bag 60 disposed inside pack 10. Interior pack 60 may be secured to the interior of membrane 40 of pack 10 at an attachment point, or a plurality of attachment points by a zipper 62, or alternatively buttons, snaps, or any other equivalent mechanism as shown in FIGS. 7 and 13. This feature of the invention permits interior pack 60 to be completely removed from membrane 40, thereby separating waterproof membrane 40 and frame 20 from interior pack 60 if desired. Alternatively, interior pack 60 may simply be left in place and accessible to a user since flap 42 may be stowed or secured beneath pack 10. As best seen in FIGS. 8, 9 and 11, flap 42 may be rolled or folded and secured via webbing straps 46 or similar fasteners below pack 10, thereby exposing interior pack 60 for user access.

Additionally, in one embodiment of the invention removable shoulder straps 26 and rigid members 30 may be detached from pack 10 and then secured to interior pack 60, through use of the adjustable webbing straps, buttons, or other fasteners, thereby providing for a packing system that provides a waterproof outer pack 10 that converts to a more conventional inner pack 60 that may be used when pack 10 is not required to be water tight. Alternatively, interior pack 60 may include its own set of shoulder straps 26, such that interior pack 60 can be utilized independently of pack 10.

This feature of the invention provides a pack 10 that is suitable and indeed superior for use in amphibious combat applications to keep gear and water-sensitive items dry while still providing rapid access thereto. Once it is necessary to access items, flap closure 42 may be quickly unzipped and then rolled up and stowed below pack 10, so that interior pack 60 is substantially exposed and accessible for a user. In one embodiment of the invention flap closure 42 is sized such that substantially all of interior pack 60 may be exposed when zipper 44 is unzipped. Alternatively, interior pack 60 may be completely removed from pack 10, and shoulder straps 26 and frame members 30 may then be removed from pack 10 and then affixed or secured to interior pack 60 through webbing straps and/or snap fasteners, whereupon interior pack 60 can simply be used as a conventional pack. Waterproof membrane 40 can then be rolled up and stowed inside pack 60 for future use.

Figure 14:
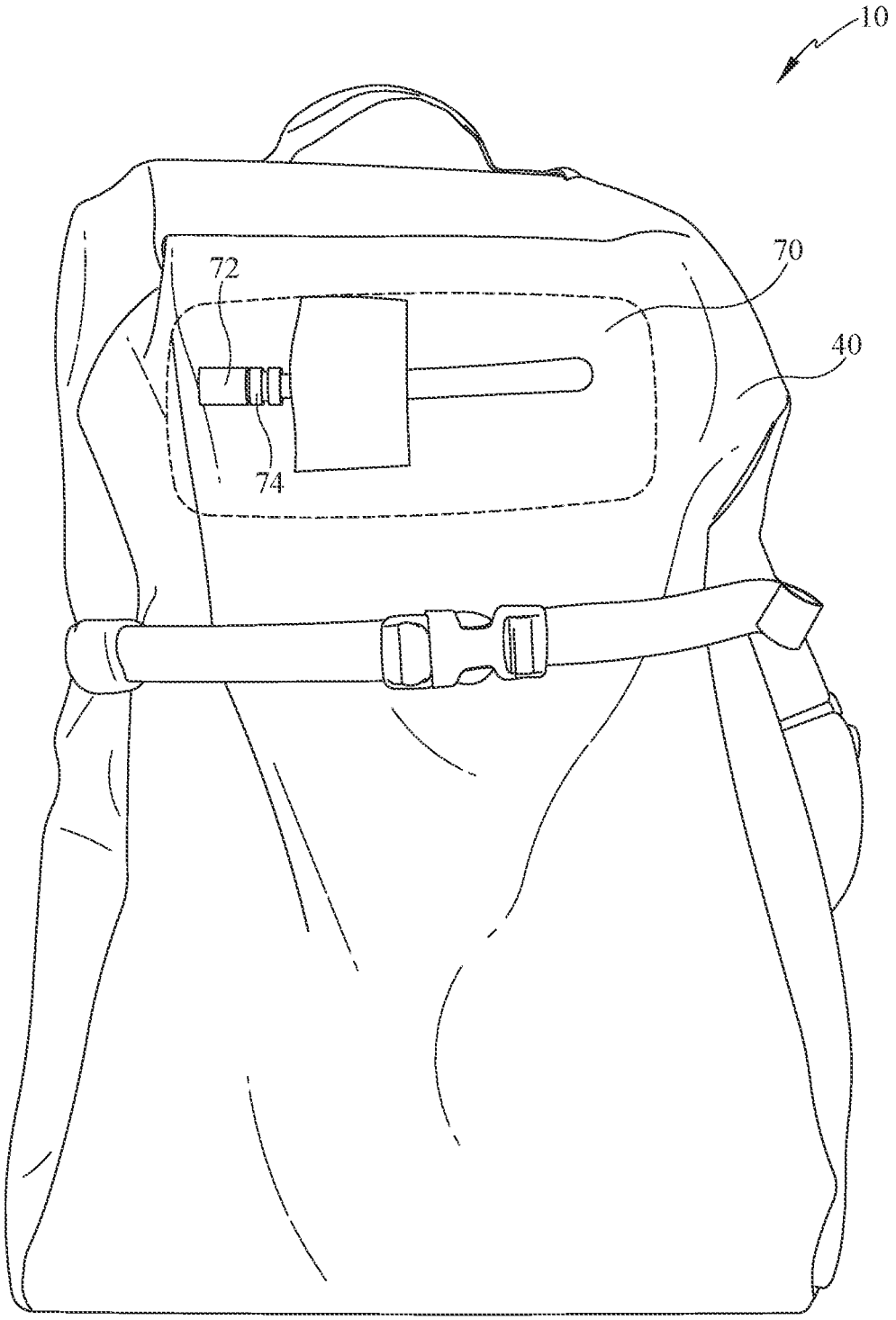
FIG. 14 is a perspective view of a waterproof pack in accordance with one embodiment of the present invention.

In a yet further embodiment of the invention as best seen in FIG. 14, an air bladder 70 or a plurality thereof, may be stowed or secured inside one or more compartments of pack 10. Bladder 70 may be inflated through an inflation tube 72 that is in fluid communication with bladder 70 so that air bladder(s) may be inflated through tube 72 by a user. Furthermore, a twist valve or bite valve 74 or similar sealing valve 74 may be in fluid communication with tube 72 (and thus bladders 70) to provide a user the ability to orally inflate bladder(s) 70, thereby providing air flotation for pack 10 and a concomitant user in the event of extended water immersion.

The foregoing detailed description of the embodiments of the invention is presented primarily for clearness of understanding and no unnecessary limitations are to be understood or implied therefrom. Modifications to the present invention in its various embodiments will become obvious to those skilled in the art upon reading this disclosure and may be made without departing from scope of the invention and the claims appended hereto.

We claim:

1. A waterproof pack for carrying articles comprising: a waterproof membrane having a body and a flap closure secured to said body by a waterproof zipper, wherein said body and said flap closure form a waterproof bag when said waterproof zipper is closed; a plurality of attachment points disposed at a plurality of interior locations in said waterproof bag; an interior pack enclosed by said waterproof bag and detachably secured to the interior of said waterproof bag to said plurality of attachment points, said attachment points comprising a zipper along a portion thereof for securing said interior pack to said waterproof bag; a frame having front and rear sides, said front side having a pair of shoulder straps secured thereto, said frame detachably secured to said waterproof membrane body at said rear side; and wherein said frame is detachable from said waterproof membrane body and securable to said interior pack when said interior pack is detached from said waterproof bag.

2. A waterproof pack as claimed in claim 1 wherein said flap closure of said waterproof membrane is sized to provide access to said interior pack.

3. A waterproof pack as claimed in claim 1 wherein said flap closure of said waterproof membrane is sized to expose said interior pack when said zipper is unzipped.

4. A waterproof pack as claimed in claim 1 wherein said flap closure of said waterproof membrane may be rolled up and secured underneath said interior pack when not in use.

5. A waterproof pack as claimed in claim 1 wherein said waterproof bag comprises a plurality of straps on a bottom portion thereof for securing said flap closure in a stowed position.

6. A waterproof pack as claimed in claim 1 comprising:

at least one air bladder secured inside said waterproof pack for providing flotation in the event of a water immersion.

* * * * *